United States Patent [19]

Seino et al.

[11] 4,175,955

[45] Nov. 27, 1979

[54] ELECTROPHOTOGRAPHIC PROCESSES USING A PRE-EXPOSURE

[75] Inventors: Kuniki Seino, Kawasaki; Shoji Kondo, Tokyo; Susumu Tanaka; Takashi Sugiyama, both of Sakai, all of Japan

[73] Assignee: Minolta Camera Kabushiki Kaisha, Osaka, Japan

[21] Appl. No.: 834,972

[22] Filed: Sep. 20, 1977

[30] Foreign Application Priority Data

Sep. 24, 1976 [JP] Japan ..... 51-114897
Oct. 27, 1976 [JP] Japan ..... 51-144858[U]

[51] Int. Cl.$^2$ ..... G03G 13/22; G03G 13/04

[52] U.S. Cl. ..... 430/35; 430/94; 355/3 R

[58] Field of Search ..... 96/1.5, 1 R, 1.3

[56] References Cited

U.S. PATENT DOCUMENTS

| | | | |
|---|---|---|---|
| 3,041,167 | 6/1962 | Blakney et al. | 96/1.3 |
| 3,249,430 | 5/1966 | Metcalfe et al. | 96/1.3 |
| 3,494,789 | 2/1970 | Makino et al. | 96/1.5 |
| 3,533,783 | 10/1970 | Robinson | 96/1 R |
| 3,813,242 | 5/1974 | Mitsusuke et al. | 96/1.5 |
| 3,837,849 | 9/1974 | Ciuffini | 96/1 R |
| 3,873,310 | 3/1975 | Bean | 96/1 R |

FOREIGN PATENT DOCUMENTS

| | | | |
|---|---|---|---|
| 42-36629 | 5/1967 | Japan | 96/1 R |

*Primary Examiner*—Roland E. Martin, Jr.
*Attorney, Agent, or Firm*—Watson, Cole, Grindle & Watson

[57] ABSTRACT

An electrophotographic process including the step of pre-exposing the surface of a photosensitive member to light at an exposure of no less than $10^3$ lx-sec, followed by the uniform charging of the same. The photosensitivity of this type photosensitive member in an image exposing step varies according to its prior history. This process further includes the step of exposing an image by projecting an optical image, corresponding to an original image, onto the photosensitive member thus charged for forming a clear electrostatic latent image, corresponding to the original image, on the surface of the photosensitive member.

5 Claims, 17 Drawing Figures

ELECTROPHOTOGRAPHIC PROCESSES USING A PRE-EXPOSURE

BACKGROUND OF THE INVENTION

1. Field of the Invention

This invention relates to an electrophotographic process, and more particularly to an improved process for use in an electrophotographic reproducing apparatus, in which a photosensitive member is used, the photosensitivity of which in an image exposing step varies according to its prior history.

2. Prior Art

U.S. Pat. No. 3,494,789 discloses a photosensitive member, in which photoconductive particles, CdS.n $CdCO_3$ ($0<n\leqq 4$), consisting of cadmium sulfide and cadmium carbonate are dispersed in an electrically insulting resin binder for use in electrophotography. Such a photosensitive member will be referred to as a CdS.n $CdCO_3$ resin photosensitive member, hereinafter.

The CdS.n $CdCO_3$ resin photosensitive member as disclosed in U.S. Pat. No. 3,494,789 provides various advantages such as (i) a high photosensitivity equivalent or superior to that of vitreous selenium and the like, (ii) a high thermal stability, (iii) low pre-exposing effect, (iv) a long service life or endurance for repeated and continuous use, (v) a simple manufacturing process, and (vi) the feasibility to use a photosensitive member with either a positive or negative polarity.

However, tests by the inventors reveal that the CdS.n $CdCO_3$ resin photosensitive member manufactured according to the process disclosed in the aforementioned patent results in a stained image. Various tests and experiments were made to clarify the reasons responsible for the stained image. As a result, it was found that a CdS.n $CdCO_3$ resin photosensitive member affords a unique hysteresis effect. This unique hysteresis effect is such that: (i) when the charge and/or amount of exposure to be imparted to the photosensitive member prior to the charging and exposing steps are varied, then the photosensitivity of the member varies in the subsequent exposing step; (ii) the photosensitivity of the photosensitive member in an exposing step, where the member has been subjected to the charging and exposing steps after the pre-exposing of the photosensitive surface of the member which has a surface-potential of zero volts, is the same as that of the photosensitive member in an exposing step, where the member has been subjected to an exposing step after the pre-exposure of the photosensitive surface thereof, which affords a high surface potential at an exposure of no less than $10^3$ lx-sec. In other words, the photosensitivity of the member in an exposing step, where the member has been pre-exposed at an exposure value of no less than $10^3$ lx-sec, is not affected by the prior history of the pre-exposing step. Additionally, this hysteresis effect lasts for several seconds to several minutes, irrespective of positive or negative charging.

As has been described earlier, when a CdS.n $CdCO_3$ resin photosensitive member is used in an ordinary reproducing process, then only stained images are obtained. This will be described in more detail hereinafter.

With a drum having a diameter on the order of 60 mm used as a photosensitive member, the circumference of the drum is approximately 190 mm, so that upon reproduction of a general copy size, for instance, A4 size (210×297 mm), the same portion of the photosensitive member is repeatedly used for a single copy sheet. For instance, in case A4 size sheet is used lenghwise, then about 60% of the surface of a photosensitive member is repeatedly used. When a CdS.n $CdCO_3$ resin photosensitive member is used as a photosensitive member, then stained-image phenomena result, such as fogging in the forward half of the first copy sheet, which corresponds to the first cycle of rotation of the photosensitive member when reproduced by shifting a reproducing apparatus from its long rest condition to its operating condition. This phenomenon is referred to hereinafter as a foggy effect. There also results a phenomenon, in which the preceding copy image doubly appears on the rear half of the copy sheet, i.e., on the surface of the copy sheet which corresponds to a doubly-used surface of the photosensitive member. This phenomenon is referred to hereinafter as a memory effect.

SUMMARY OF THE INVENTION

It is an object of the invention to provide an electrophotographic process which prevents the occurrence of a stained copy image.

It is a further object of the invention to provide an electrophotographic process which is well adapted for use with a CdS.n $CdCO_3$ resin photosensitive member.

It is still a further object of the present invention to provide an electrophotographic process which prevents the occurrence of a stained copy image and is well adapted for use with a photosensitive member which has been sensitized.

It is yet a further object of the present invention to provide an electrophotographic process, which eliminates the effect of prior history produced by a pre-exposing step with an exposure of no less than $10^3$ lx-sec, and provides specific hysteresis charging and hysteresis exposing steps between the pre-exposing step at an exposure of no less than $10^3$ lx-sec, and charging and exposing steps, thereby increasing the photosensitivity of an image exposing step.

These and other objects, advantages and features of the invention will become apparent from the following description thereof, when read in conjunction with the accompanying drawings which illustrate exemplary embodiments of the invention.

BRIEF DESCRIPTION OF THE DRAWINGS

In the following description, like parts are designated like reference numerals throughout the several diagrams of the attached drawings.

DESCRIPTION OF THE PREFERRED EMBODIMENTS

For the purpose of clarifying the stained-image phenomena, such as memory effect and foggy effect and the like, which are caused due to the hysteresis effect previously described, a photoconductive member was subjected to charging and exposing steps to establish a history, followed by uniform charging and exposure. Then, the photosensitivity of a Cds.n $CdCO_3$ resin photosensitive member was measured and the measurements classified into nine types, a–i (Table 1). In this respect, relative photosensitivities are shown in Table 1, with the lowest photosensitivity being assumed as 1. The relative photosensitivity is defined by a ratio of the inverse numbers of the photo-attenuating rates.

Table 1

Figure 1:
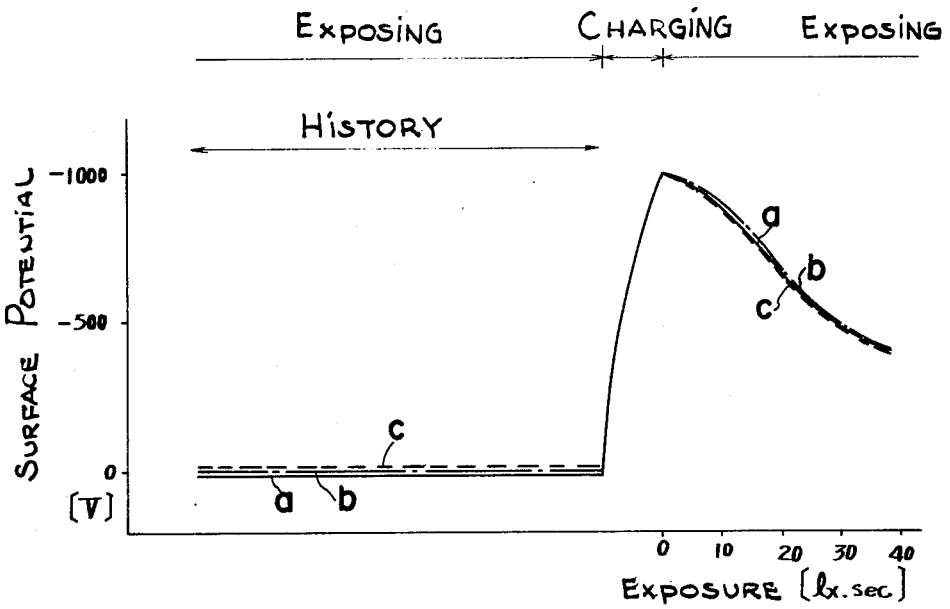
FIGS. 1, 2 and 3 are graphs illustrative of the characteristics of a CdS.n $CdCO_3$ resin photosensitive member.
Figure 2:
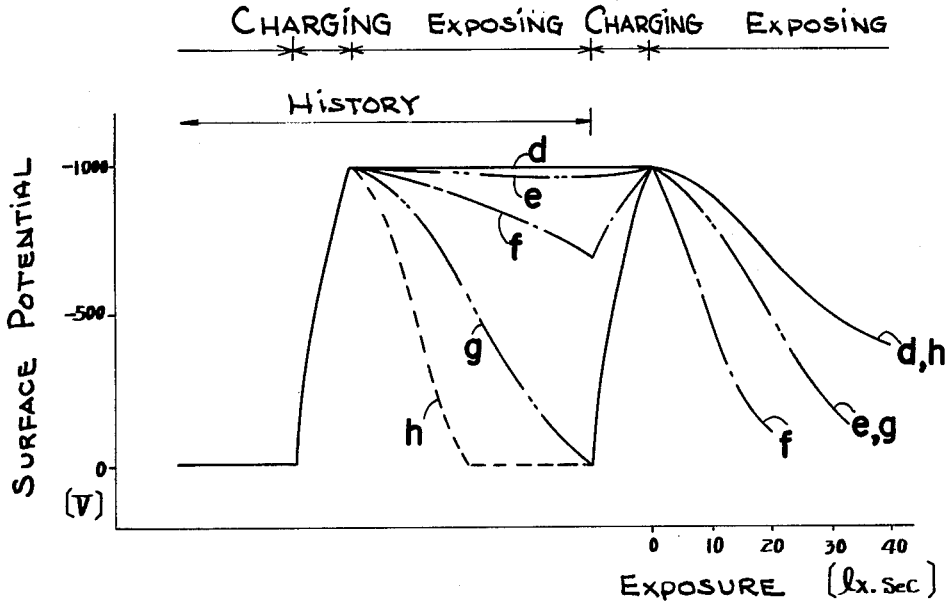
Figure 3:
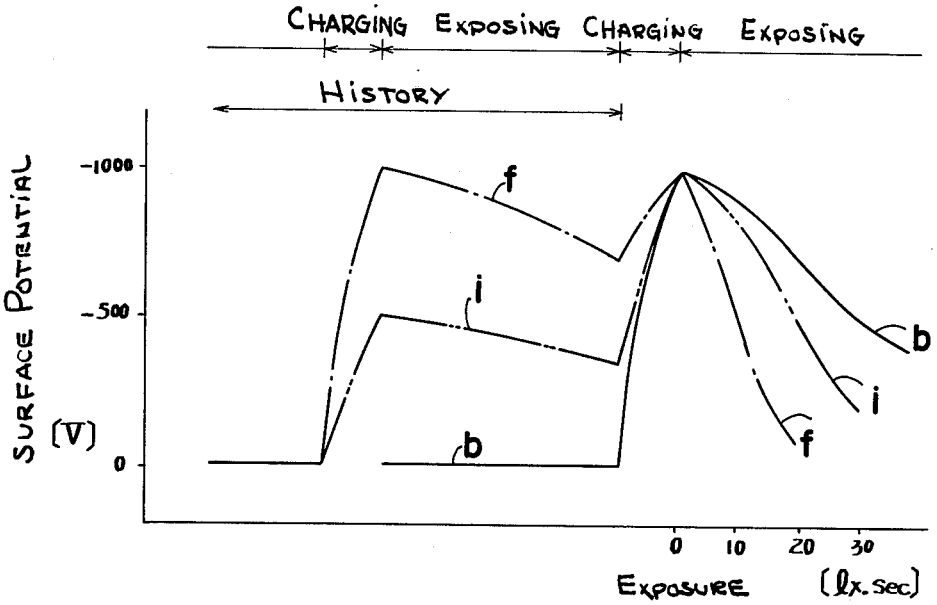

| type of history | hysteresis charging potential (V) | amount of hysteresis exposure (lx-sec) | relative photo-sensitivity | associated drawing |
|---|---|---|---|---|
| a | 0 | $<10^{-1}$ | 1 | |
| b | 0 | $\sim 10^{1}$ | 1 | Fig. 1 |
| c | 0 | $>10^{3}$ | 1 | |
| d | − 1000 | $<10^{-1}$ | 1 | |
| e | − 1000 | $\sim 10^{0}$ | 2 | |
| f | − 1000 | $\sim 10^{1}$ | 3 | Fig. 2 |
| g | − 1000 | $\sim 10^{2}$ | 2 | |
| h | − 1000 | $>10^{3}$ | 1 | |
| b | 0 | $\sim 10^{1}$ | 1 | |
| i | − 500 | $\sim 10^{1}$ | 2 | Fig. 3 |
| f | − 1000 | $\sim 10^{1}$ | 3 | |

A step for providing an exposure of no less than $10^3$ lx-sec is referred to as a pre-exposing step, while steps for charging and exposing a photosensitive member in order to attain a predetermined specific history of the photosensitive member, following the pre-exposing step, are referred to as a hysteresis charging step, and a hysteresis exposing step, respectively.

The following description is of the types of histories shown in Table 1 in conjunction with the accompanying drawings corresponding thereto. As shown in FIG. 1, only a hysteresis exposing step is given to the photosensitive member having a surface potential of zero volts at three different exposures. The hysteresis exposing step does not affect charge-receptive capability and photosensitivity.

FIG. 2 is a graph showing changes in photosensitivity in an exposing step with respect to different hysteresis exposures, when the steps include charging at a constant charge level and exposing. As shown in FIG. 2, the photosensitivities of the histories of the types, f, e, g are improved several times, as compared with the photosensitivities of the histories of the types, a, b, c in FIG. 1 and d, h in FIG. 2. This phenomenon is attributable to the fact that the photosensitivity is increased due to the hysteresis charging and exposing steps, and hence is referred to as hysteresis sensitization. The relative photosensitivity due to the hysteresis sensitization peaks at a certain level hysteresis exposure, at a constant charge level.

FIG. 3 is a graph showing a change in photosensitivity in an exposing step after charging with different charge levels, exposing with a constant low hysteresis exposure, and constant charging. In this case, the higher the hysteresis charge level, the higher the photosensitivity.

It should be recognized in the above respective types that histories a, b, c, and d, h afford the same photosensitivity, and that histories f, e, g provide a photosensitivity several times higher than that of the former mentioned histories. In this case, the higher the hysteresis charge level, the higher the photosensitivity, although the photosensitivity peaks at a certain level of hysteresis exposure.

Figure 4:
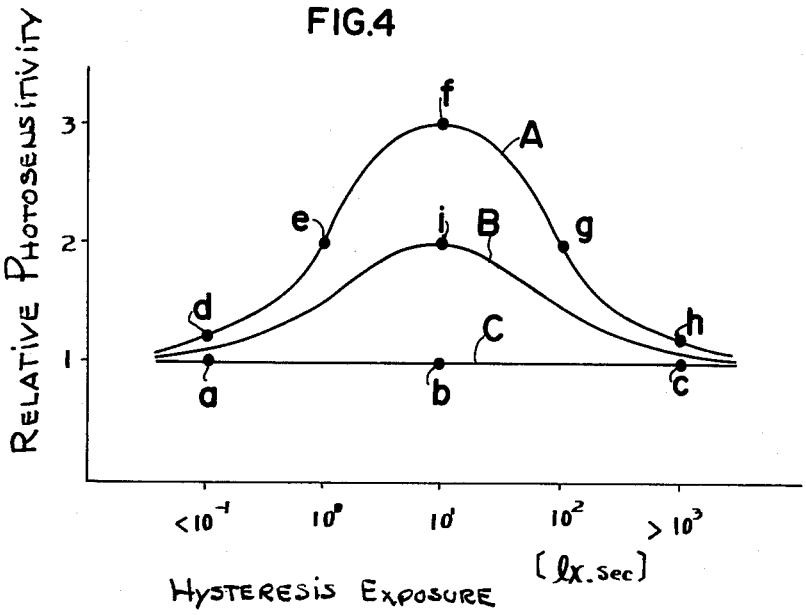
FIG. 4 is a graph of the summarized characteristics presented in FIGS. 1, 2 and 3.

FIG. 4 is a graph showing the histories of the aforesaid respective types, in terms of the relationship between the amount of hysteresis exposure and the relative photosensitivity subsequent to the history, with the charge potentials in the hysteresis charging step being taken as parameters.

The reason for the forward-half foggy effect and memory effect will now be described with reference to FIG. 4. The reproducing process comprised a conventional reproducing step for a drum of an approximate diameter of about 60 mm, i.e., a light irradiating step using an eraser lamp at an exposure in the order of $10^1$ lx-sec, a charging step for charging the surface of the photosensitive member to −1000 V by means of a corona charger, an image exposing step at an exposure level on the order of $10^1$ lx-sec, and a latent image transfer step. The reproducing process as referred to herein is an electrostatic latent image transfer type process which has been developed and used in practical applications, in which an electrostatic latent image formed on the surface of a photosensitive member is transferred onto the insulating surface of a copy sheet, after which the electrostatic latent image formed on the copy sheet is developed and fixed for obtaining a copied image. This electrostatic latent image transfer type reproducing apparatus does not include a developing device and a toner cleaning device for the photosensitive member, thereby allowing the use of a photosensitive drum of a considerably small diameter, thereby resulting in a reduction in the size and simplicity of maintenance of the reproducing apparatus. Additionally, the type of paper used as a copy sheet resembles that of plain paper, compared with a copy sheet having a photosensitive surface, which is used in an electro-fax type reproducing apparatus. Further, the electrostatic latent image transfer type apparatus affords the advantage of producing a copied image of good quality.

The following description is with respect to the occurrence of forward-half fogging phenomenon in the case of conventional reproducing apparatus. The history for the first cycle of drum rotation corresponds to history b in FIG. 1, because the history includes the irradiation of light from an eraser alone. However, the history for the second cycle of drum rotation includes image exposure (at about $10^1$ lx-sec) and light irradiation by the eraser (at about $10^1$ lx-sec), so that the history corresponds to history f of FIG. 2. As a result, the photosensitivity of the drum during the second cycle of rotation is higher than that during the first cycle of rotation. The copy image resulting from the first cycle of rotation of the drum is somewhat under-exposed, as compared with the copied image resulting from the second and subsequent cycles of rotation, with the result that charges on a non-imaged portion of the photosensitive member are not sufficiently removed, causing forward-half fogging.

The reason for the occurrence of memory effect is that, since the photosensitive member, during the second cycle of drum rotation, is influenced by the historical image exposure during the first cycle of drum rotation, there is a difference in photosensitivity between a non-image portion (light-irradiated portion) and an image portion (non-light-irradiated portion) of the photosensitive member during the second cycle of drum rotation. A portion of the drum, which has a history as a non-image portion, is subjected to charging (−1000 V), image exposure and light-irradiation by means of an eraser, during the second cycle of drum rotation, so that the aforesaid portion of the drum provides history f. However, a portion of the drum, which has served as an image portion, is subjected to charging (−1000 V), lowering in potential due to latent image transfer, and light irradiation by an eraser (photo-attenuation takes place at an exposure of $10^1$ lx-sec) from a −500 V level which is obtained due to the transfer. Accordingly, the aforesaid portion of the drum provides history i. Thus, an image in the forward half of the sheet doubly appears in the rear half of the transfer sheet due to the difference in photosensitivity between the histories f and i.

The forward-half fogging, and memory effects are attributable to a difference in photosensitivity between the first and second cycles of drum rotation, i.e., between the image portion and the non-image portion on the photosensitive member. Accordingly, for solving the aforesaid stained-image phenomena, it is mandatory that the photosensitivity be maintained constant.

Figure 5:
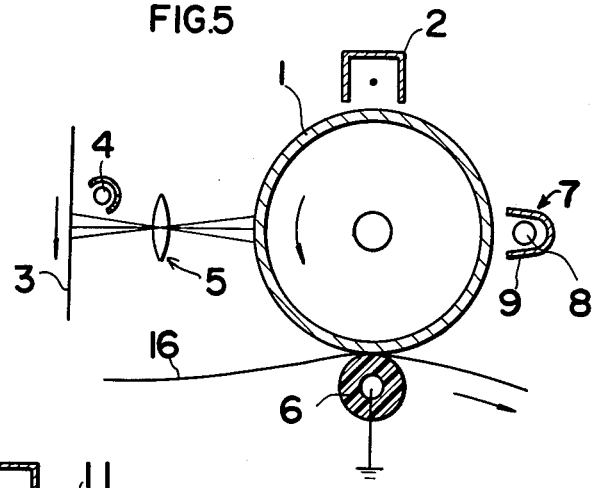
FIG. 5 is a cross-sectional view of an essential part of an electrophotographic reproducing apparatus, illustrating the electrophotographic process according to the invention.

The first embodiment of the invention is directed to solving the aforesaid stained-image phenomena by utilizing the principle that, in the case where the photosensitive member is subjected to light at an exposure of $10^3$ lx-sec prior to the charging step, then a constant photosensitivity may be achieved, irrespective of the previous charge level provided for the aforesaid exposure. In this case, the embodiment includes, as shown in FIG. 5, a corona charger 2 for uniform charging, which is positioned on the periphery of small diameter photosensitive drum 1 which is adapted to rotate counterclockwise; light source 4 and optical system 5 for projecting an image corresponding to original 3 onto the surface of the photosensitive member; transfer roller 6 for transferring an electrostatic latent image formed on the surface of the photosensitive member onto the surface of transfer sheet 16; and lamp 8. Lamp 8 has reflecting shade 9 and is a high illuminance lamp providing an exposure of no less than $10^3$ lx-sec.

The following description concerns the prevention of stained-image phenomena with reference to the embodiment of FIG. 5 as well as to FIG. 4. The history of the drum during the first cycle of rotation is exposure to light at an exposure of no less than $10^3$ lx-sec, and hence corresponds to history c. However, the history of the photosensitive member during the second cycle of drum rotation includes charging by charger 2, image exposure, and transfer. However, the photosensitive member is subjected to the pre-exposing step at an exposure of no less than $10^3$ lx-sec, so that the hysteresis describes a photo-attenuating curve represented by h. This photosensitivity substantially the same as that of history c, so that no forward-half fogging takes place. In addition, the photosensitive member which has served as an image portion and non-image portion during the first cycle of drum rotation has been subjected to a pre-exposing step at an exposure of no less than $10^3$ lx-sec, thereby providing uniform photosensitivity represented by history h, so that no memory effect results, although the charging potential is different between the image portion and the non-image portion.

Many attempts using erasers are known, in which the exposure at most is several times as high as the exposure in the image-exposing portion, i.e., an exposure on the order of $10^1$ to $10^2$ lx-sec in terms of a CdS.n $CdCO_3$ resin photosensitive member, and thus is effective for a photosensitive member having no hysteresis effect. However, for a photosensitive member affording marked hysteresis effects, such as a CdS.n $CdCO_3$ resin photosensitive member, the aforesaid attempts have failed to prevent the stained-image phenomena described earlier, so that a photosensitive member having no other hysteresis effect should necessarily be used. The present invention is based on the discovery that with light irradiation (in the pre-exposing step) at an exposure of no less than $10^3$ lx-sec, then there may be achieved a constant photosensitivity, irrespective of the charge level given prior to the light irradiation, thereby preventing the stained image phenomena. Thus, there is achieved a superior operation than that of the prior art process, in which an eraser is used for eliminating uneven charge density on the surface of a photosensitive member, prior to the charging and exposing steps.

The second embodiment of the invention is directed to the prevention of stained image phenomena for improving the photosensitivity of a photosensitive member in a reproduction process. After the pre-exposing step at an exposure of no less than $10^3$ lx-sec, the photosensitive member is subjected to a hysteresis charging step and a hysteresis exposing step for providing a given history, thereby improving the photosensitivity. Stated differently, the present invention resorts to hysteresis sensitization.

Figure 6:
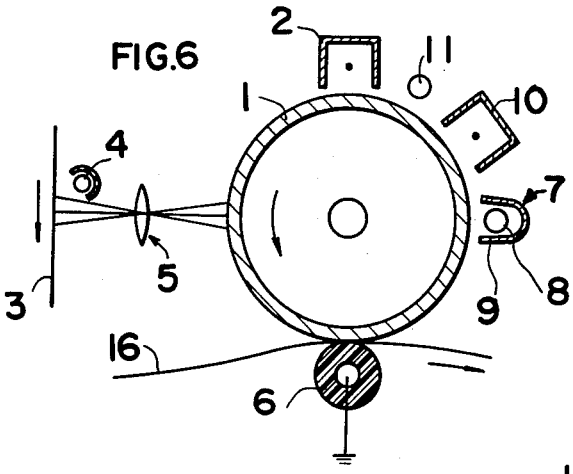
FIG. 6 is a cross-sectional view of an essential part of an electrophotographic reproducing apparatus, illustrating the electrophotographic process of another embodiment of the invention.

As in the preceding embodiment, the second embodiment includes, as shown in FIG. 6, corona charger 2 for uniformly charging small diameter drum 1, which charger is positioned on the periphery of drum 1 which is adapted to rotate counterclockwise; illuminating source 4, and an optical system for projecting an image corresponding to original 3 onto the surface of the photosensitive member; transfer roller 6 for transferring a latent image formed on the surface of the photosensitive member; and lamp 8 affording an exposure of no less than $10^3$ lx-sec. The second embodiment, however, further includes hysteresis charger 10 and hysteresis exposing lamp 11 which are disposed between lamp 8 and charger 2. According to the present invention, the photosensitivity may be increased up to three times by setting the potential of the charges given by hysteresis charger 10 and the exposure provided by hysteresis exposing lamp 11 to amounts suited for the embodiment. For increasing the photosensitivity three times, it is preferable that the potential of charges given by hysteresis charger 10 are equal to or exceed the potential provided by charger 2. The exposure provided by hysteresis exposing lamp 11 is set to the order of 10 to 500 lx-sec. The reason for this broad range is most likely due to changes in the photosensitive characteristic of the photosensitive member which may vary by minor amounts in the manufacturing process in spite of the use of the same constituents.

The history of the photosensitive member which is provided by this embodiment includes a pre-exposing step at an exposure of no less than $10^3$ lx-sec, hysteresis charging (−1000 V), hysteresis exposing at an exposure on the order of 10 lx-sec, and charging to −1000 V, thus corresponding to history f in FIG. 2. The photosensitivity is increased several times more than the photosensitivity according to the preceding embodiment of the invention, which resorts to a pre-exposing step at an exposure of no less than $10^3$ lx-sec. Additionally, the photosensitive member is subjected to a pre-exposing step at an exposure of no less than $10^3$ lx-sec, to reduce the surface potential of the photosensitive member to zero at all times, followed by hysteresis charging and exposing steps, with the result that, apart from a difference between the first cycle of rotation and the second cycle of drum rotation, as well as a difference between the image portion and non-image portion, the photosensitive member may have a given history at all times, thereby precluding the possibility of occurrence of stained image phenomena such as forward half foggy and memory effects, and the like.

Figure 7:
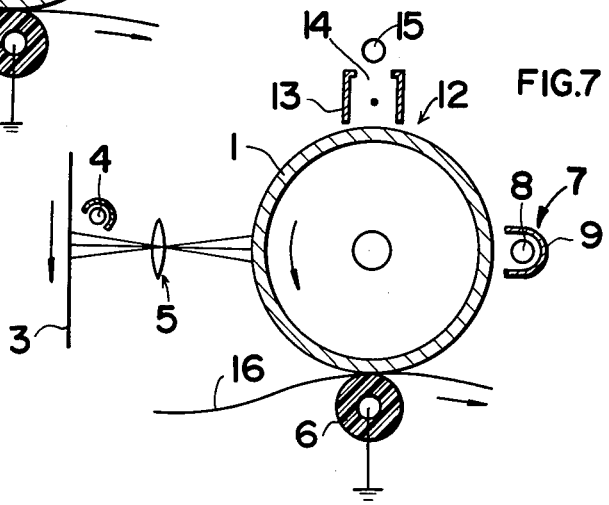
FIG. 7 is a cross-sectional view of an essential part of an electrophotographic reproducing apparatus, illustrating a modification of the electrophotographic process according to the invention.

FIG. 7 shows one modification of the embodiment of FIG. 6. This modification includes simultaneous charging and exposing means 12 incorporating hysteresis charger 10, hysteresis exposing lamp 11 and corona charger 2, as shown in FIG. 6. In this modification, opening 14 is provided in an upper shield plate for charger 13, with lamp 15 affording an exposure on the order of 10 lx-sec, and being positioned in opening 14. In this respect, the surface potential of the photosensitive member eventually reaches −1000 V, so that charger 13 should be of a higher output type as compared with an ordinary charger type.

Figure 8:
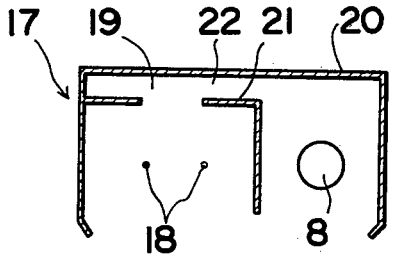
FIGS. 8, 9 and 10 are views showing respective units for performing the steps prior to the image exposing step in the process carried out by the apparatus of FIG. 7, and its modification.
Figure 9:
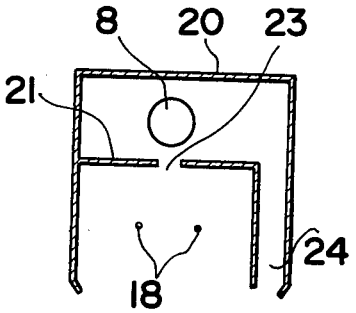
Figure 10:
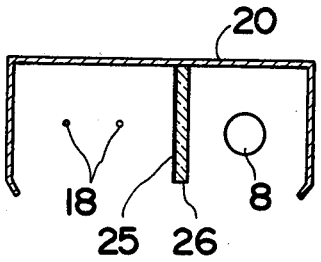

FIG. 8 shows an embodiment including unit 17 incorporating simultaneous charging and exposing means 12 of FIG. 7 and high illuminance lamp 8. FIGS. 9 and 10 show modifications thereof. As shown in FIG. 8, high illuminance lamp 8 is positioned to the right of external frame 20, and internal frame 21 is provided as a shield plate to the left of external frame 20. Corona wire 18 runs through internal frame 21, thus serving as a charger. Further, opening 19 is defined in the top surface of internal frame 21, so that light from lamp 8 is introduced through light-introducing portion 22 defined between external frame 20 and internal frame 21, and then out through opening 19 for the simultaneous charging and exposing steps.

As shown in FIG. 9, light is emitted from high illuminance lamp 8 positioned directly above opening 23 defined in internal frame 21, for the simultaneous charging and exposing steps. Light irradiation is generated by light-introducing portion 24 at an exposure of no less than $10^3$ lx-sec. In this case, opening 23 directly receives the light from lamp 8, unlike the type, in which scattered light is utilized, so that the size of opening 23 should be reduced considerably, as compared with that of opening 19.

FIG. 10 shows an embodiment in which lamp 8 and corona wire 18 are provided parallel to each other, interiorly of external frame 20. Lamp 8 and corona wire 18 are partitioned by transparent glass 26 having a metal-evaporated thin film on one of its surfaces on the side of the corona wire. The light emitted from lamp 8 erases an image on the photosensitive member with a high illuminance at an exposure of no less than $10^3$ lx-sec, which is transmitted through transparent glass 26 and metal evaporated thin film 25 for simultaneous charging and exposing.

External frame 20 and internal frame 21 are generally made of an aluminum plate, and subjected to aventurine-finishing for diffusing the light thereon for uniformity of light distribution. However, in the embodiment of FIG. 9, light-introducing portion 24 may be finished to a mirror surface for efficient light transmission.

The preceding description has been given with reference to the numerical values shown in Table 1. It should be noted, however, that the numerical values in Table 1 are exemplary typical values given for better understanding of the invention. Even if the hysteresis exposure values are set as shown in Table 2, which is somewhat different from that of Table 1 and applied to a CdS.n $CdCO_3$ resin photosensitive member having somewhat different photosensitivity from that used previously, the graphs shown in FIGS. 1, 2, 3, 4 are only changed to that shown in FIGS. 11, 12, 13, 14, and the hysteresis effect may be explained in the aforesaid manner. The reference characters having primes correspond to those in FIGS. 1, 2, 3, 4, respectively.

Table 2

Figure 11:
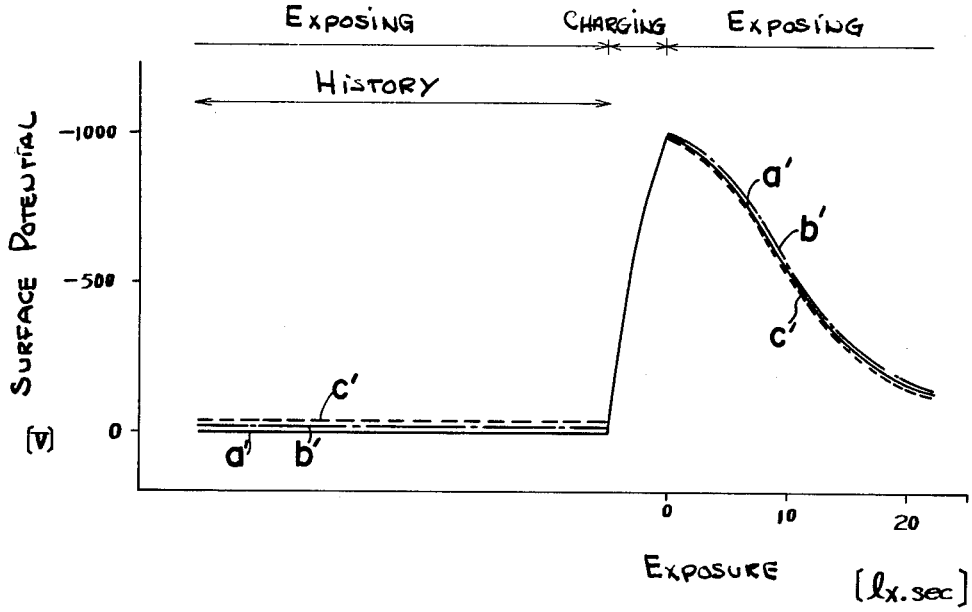
FIGS. 11, 12, 13 and 14 are graphs illustrative of the characteristics of a CdS.n $CdCO_3$ resin photosensitive member, each of which is similar to FIGS. 1, 2, 3 and 4 and based on Table 2 included herein.
Figure 12:
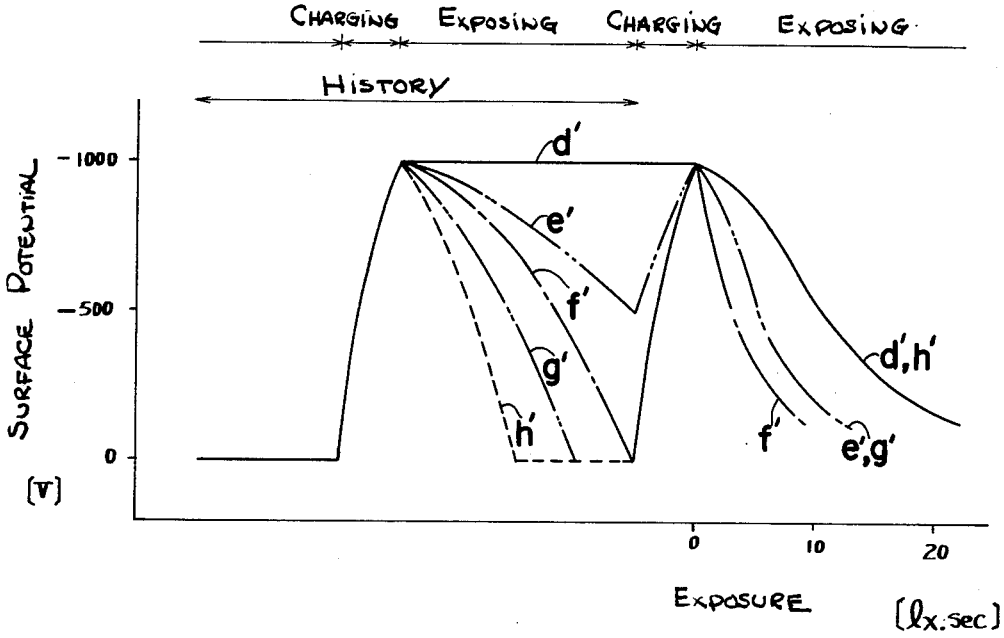
Figure 13:
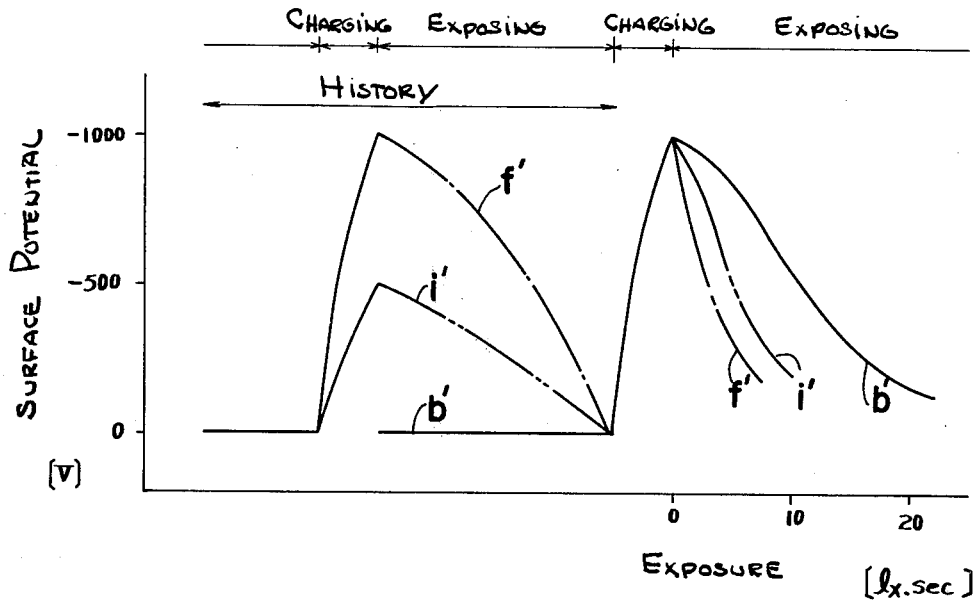
Figure 14:
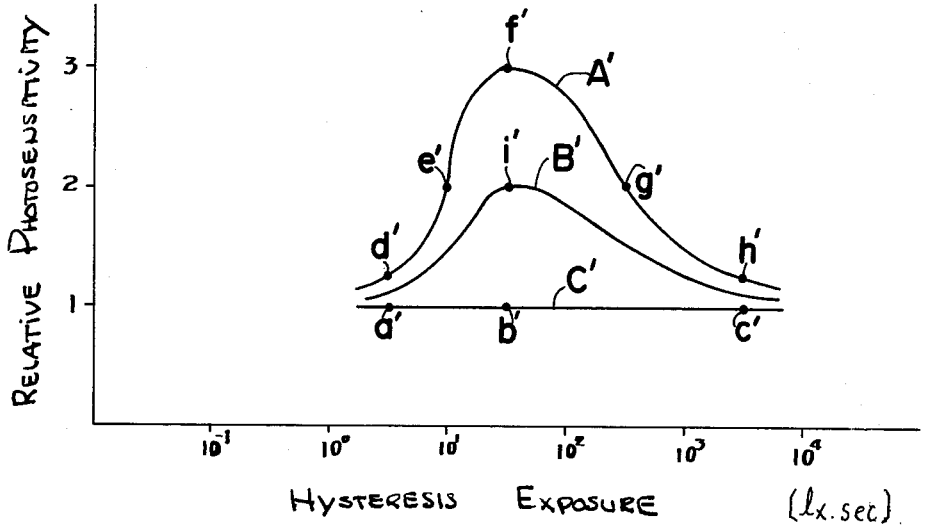

| type of history | hysteresis charging potential (V) | amount of hysteresis exposure (lx-sec) | relative photo-sensitivity | associated drawing |
|---|---|---|---|---|
| a′ | 0 | $5 \times 10^0$ | 1 | Fig. 11 |
| b′ | 0 | $5 \times 10^1$ | 1 | |
| c′ | 0 | $5 \times 10^3$ | 1 | |
| d′ | −1000 | $5 \times 10^0$ | 1 | Fig. 12 |
| e′ | −1000 | $10^1$ | 2 | |
| f′ | −1000 | $5 \times 10^1$ | 3 | |
| g′ | −1000 | $5 \times 10^2$ | 2 | |
| h′ | −1000 | $5 \times 10^3$ | 1 | |
| b′ | 0 | $5 \times 10^1$ | 1 | Fig. 13 |
| i′ | −500 | $5 \times 10^1$ | 2 | |
| f′ | −1000 | $5 \times 10^1$ | 3 | |

As is apparent from the foregoing description, according to the invention, a pre-exposing step at an exposure of no less than $10^3$ lx-sec is applied, so that the photosensitivity of a photosensitive member may be maintained constant, thereby completely preventing stained image phenomena.

Moreover, according to the present invention, the stained-image phenomena may be prevented by a pre-exposing step at an exposure of no less than $10^3$ lx-sec, and the photosensitive member may be sensitized by the histories of hysteresis charging and hysteresis exposing, i.e., the present invention provides a high sensitivity latent image forming process utilizing hysteresis sensitization. Accordingly, the process according to the invention is well suited for a small diameter drum, for which the exposure slit provided immediately in the front of the photosensitive drum is reduced in width, for allowing sharp focusing of an optical image of an original, which is to be projected through an optical system, at the sacrifice of less exposure.

For the convenience of the description, there has been reference to an electrostatic transfer system using a small diameter drum, which is provided with a CdS.n $CdCO_3$ resin photosensitive member. However, the present invention is by no means limited to such parameters, and hence any photosensitive member exhibiting photosensitivity characteristics similar to that of a CdS.n $CdCO_3$ resin photosensitive member may be used. Additionally, the process according to the invention is found to be effective in preventing stained-image phenomena occurring in high speed continuous reproduction by means of a large diameter drum. Also, according to the electrostatic latent image transfer system, a delicate change in the electrostatic latent image formed may be reproduced, so that marked stained image phenomena take place. However, a powder image transfer system is no exception to this problem, and the process according to the invention may also solve the memory effect, in the same manner.

Finally, the results of tests given in association with the present invention are described hereinafter.

Test I

A prior art process which includes the steps of light irradiation at an exposure on the order of 50 lx-sec, and charging-image exposing and latent-image transferring, by using a CdS.n $CdCO_3$ resin photosensitive member ($0.8 \leqq n \leqq 1.0$) was compared with the process according to the present invention as shown in FIGS. 5, 6 and 7, with respect to copied images obtained therefrom. The prior art process resulted in forward-half foggy and memory effects, thereby being unusable in a practical application. The process according to the present invention is devoid of a stained image, and provides a clear image. Table 3 shows the test parameters.

Table 3

| | process of the invention | | | prior art |
|---|---|---|---|---|
| | embodiment of FIG. 5 | embodiment of FIG. 6 | embodiment of FIG. 7 | process |
| light irradiation | 26500 lx<br>0.13 sec | 26500 lx<br>0.13 sec | 26500 lx<br>0.13 sec | 390 lx<br>0.13 sec |
| hysteresis charging | | −1000 V<br>(current . . . about 100 μA) | charged simultaneat 1000 lx and 0.01 sec, and finally charged to −1000 V. (current . . . about 200 μA) | |
| hystersis exposing | | 30000 lx<br>0.01 sec | | |
| charging | −1000 V | −1000 V | | −1000 V |

Test II

Figure 15:
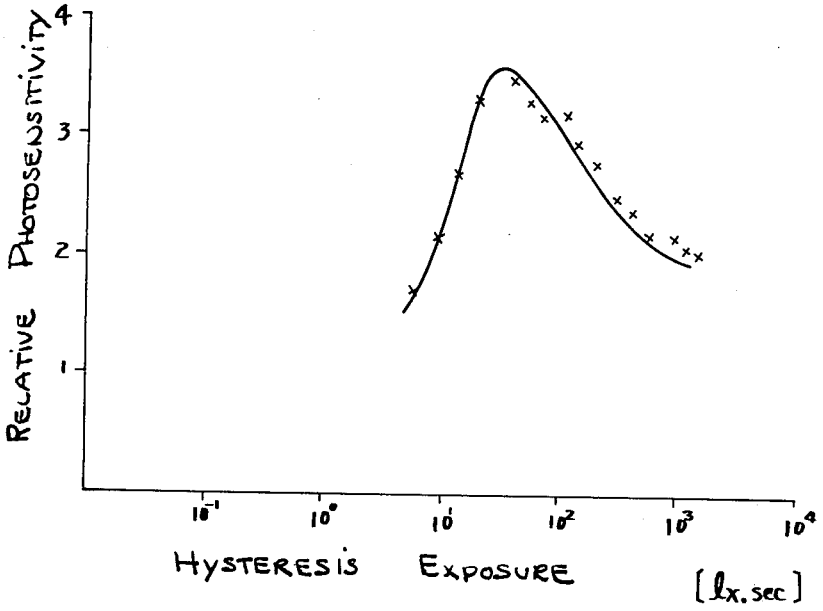
FIGS. 15, 16 and 17 are graphs illustrative of the results of tests conducted by the inventors.

For confirming the photosensitivity obtained according to the invention, the surface potential for the charging steps was set to −1000 V, prior to the hysteresis charging and image exposing steps, and the exposure values for the hysteresis exposure were varied, for measuring changes in photosensitivity of the image exposing step. The photosensitivity is defined as the ratio of inverse numbers of the exposure values when the surface potential drops from −1000 V to −450 V due to the light irradiation corresponding to the image exposure. In this respect, the photosensitivity is given as 1, when the photosensitive member of a surface potential of zero volts is charged to −1000 V. FIG. 15 shows the results of this test.

Figure 16:
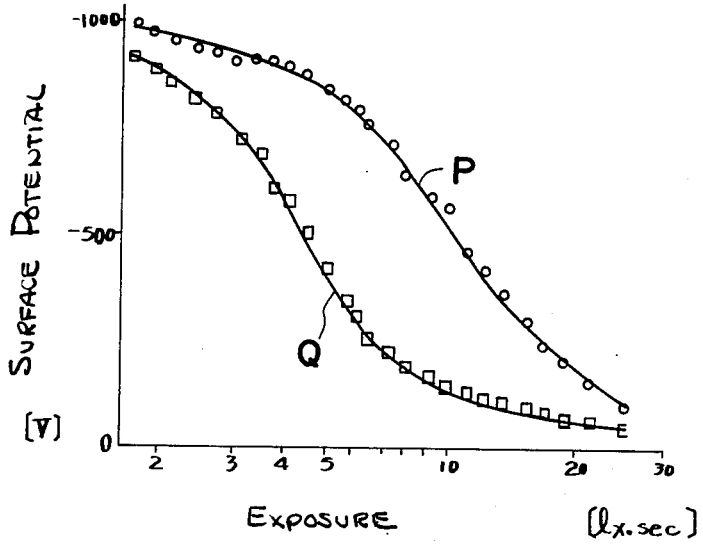

Photo-attenuating curves P and Q of photosensitive members were measured, i.e., a photosensitive member which has been subjected to erasing at an exposure of 26500 lx, and 0.13 sec according to the embodiment of FIG. 5, (curve P); and another photosensitive member which has been subjected to erasing at an exposure of 26500 lx and 0.13 sec, hysteresis charging to −1000 V, hysteresis exposure at an exposure of 30000 lx and 0.01 sec, and charging to −1000 V, according to the embodiment of FIG. 6 (curve Q). FIG. 16 shows the results of the measurements.

In FIG. 16, the exposure, when the surface potential drops from −1000 V to −450 V, is 11.2 lx-sec according to curve P, and 4.5 lx-sec according to curve Q. Apparently, the photosensitivity of a photosensitive member according to the embodiment of FIG. 6 was increased by 2.5 times. This photosensitivity is attributable to the history given to the photosensitive member.

Figure 17:
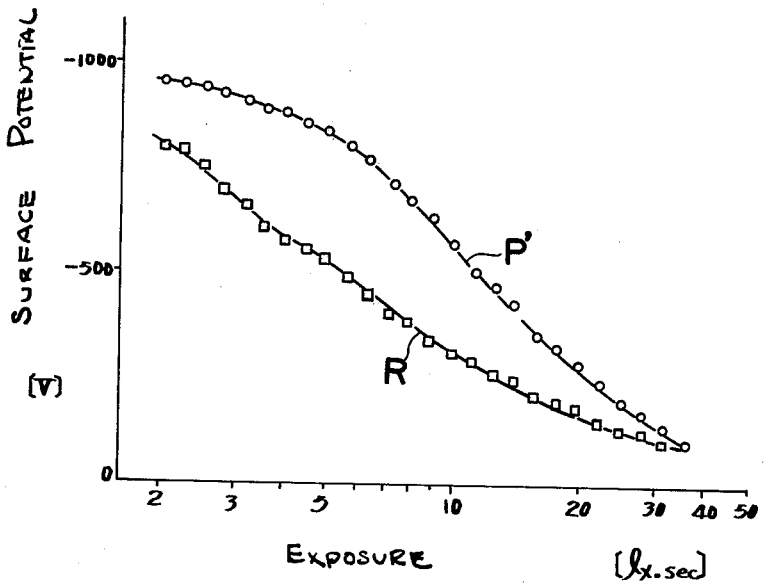

The embodiment of FIG. 5 was compared with the embodiment of FIG. 7 with respect to a CdS.n $CdCO_3$ resin photosensitive member ($0.8 \leqq n \leqq 1.0$). FIG. 17 shows the results of the comparison tests. The test data for the embodiment of FIG. 5 is the same as that for the embodiment of FIG. 16, and are represented by photo-attenuating curve P'. In the embodiment of FIG. 7, a photo-attenuating curve R of a photosensitive member was measured, which member was subjected to the erasing at an exposure of 26500 lx and 0.13 sec, followed by the simultaneous exposure at an exposure of 1000 lx and 0.01 sec charging, and finally the application of a surface potential of −1000 V.

In FIG. 17, the exposure, when the surface potential drops from −1000 V to −450 V, is 16.5 lx-sec according to curve P', and 10 lx-sec according to curve R. Apparently, the photosensitivity of the photosensitive member according to the embodiment of FIG. 7 is increased by 1.65 times.

The reason why the photo-attenuating curves for the embodiment of FIG. 5 differ from those of the embodiments of FIGS. 6 and 7 is considered to be caused by minor differences in the manufacturing process of the photosensitive members used.

What is claimed is:

1. An electrophotographic process for repetitively forming an electrostatic latent image corresponding to an original onto a photosensitive member having hysteresis characteristics in which the photosensitivity of said photosensitive member in an image exposing step varies in accordance with the exposing and/or charging level of previous latent image forming steps, comprising the steps of:

pre-exposing said photosensitive member with an exposure level greater than $10^3$ lx-sec;

uniformly charging said photosensitive member with a specific charge polarity to a predetermined surface potential;

uniformly exposing said photosensitive member with light of a predetermined exposure level;

uniformly charging said photosensitive member with the same charge polarity as in the first charging step; and exposing the image corresponding to the original onto the uniformly charged photosensitive member, whereby influence from said hysteresis characteristics is avoided by said pre-exposing step and the first uniform charging and exposing steps enable a predetermined specific history to be formed on said photosensitive member to obtain increased and constant photosensitivity.

2. An electrophotographic process as in claim 1, wherein said photosensitive member includes CdS.n $CdCO_3$ ($0<n\leqq 4$).

3. An electrophotographic process as in claim 1, wherein said uniform exposing step includes the application of an exposure level in the range of 1–1000 lx-sec.

4. An electrophotographic process as in claim 1, wherein said first charging step includes application of substantially the same or greater potential as that of said second charging step.

5. An electrophotographic process for forming an electrostatic latent image corresponding to an original onto a photosensitive member including CdS.n $CdCO_3$ ($0<n\leqq 4$) having hysteresis characteristics in which the photosensitivity of the photosensitive member in image exposing steps varies in accordance with the previous exposing and/or charging level whereby the previous charging and/or exposure history influences the photosensitivity of said photosensitive member in the image exposing step resulting in stained copy patterns, comprising the steps of:

pre-exposing said photosensitive member with an exposure level greater than $10^3$ lx-sec;

uniformly charging said photosensitive member with a specific polarity to a predetermined surface potential;

uniformly exposing said photosensitive member with the light of a predetermined exposure level in the range of 1–1000 lx-sec;

uniformly charging said photosensitive member with the same polarity as in the first charging step and the potential to be applied being substantially the same potential as that of said first charging step; and exposing the image corresponding to the original onto the uniformly charged photosensitive member, whereby influence from said hysteresis characteristic is avoided by said pre-exposing step, and said first charging and uniform exposing steps enable a predetermined specific charging and exposing history to be formed on said photosensitive member to obtain increased and constant photosensitivity.

* * * * *